United States Patent [19]

Nagelkirk

[11] 4,320,852

[45] Mar. 23, 1982

[54] MOBILE FILE LID

[75] Inventor: Preston Nagelkirk, Zeeland, Mich.

[73] Assignee: Herman Miller, Inc., Zeeland, Mich.

[21] Appl. No.: 202,714

[22] Filed: Oct. 31, 1980

[51] Int. Cl.[3] ..... B65D 43/14; B65D 51/04

[52] U.S. Cl. ..... 220/331; 312/276; 312/189

[58] Field of Search ..... 220/331, 335; 312/189, 312/276, 138 R, 313, 323; 49/254, 395

[56] References Cited

U.S. PATENT DOCUMENTS

| | | | |
|---|---|---|---|
| 2,071,930 | 2/1937 | Hunter | 220/331 X |
| 2,323,093 | 6/1943 | Levin | 220/331 |
| 2,338,477 | 1/1944 | Wolters et al. | 312/189 |
| 2,545,959 | 3/1951 | King | 220/331 X |
| 2,682,351 | 6/1954 | Durand et al. | 220/331 X |
| 2,758,744 | 8/1956 | Spindler et al. | 220/331 |
| 2,837,722 | 9/1974 | Ceccarelli | 312/276 |
| 3,961,723 | 6/1976 | Eckel | 220/331 |
| 4,262,447 | 4/1981 | Schneier et al. | 220/331 X |

*Primary Examiner*—George T. Hall
*Attorney, Agent, or Firm*—Varnum, Riddering, Wierengo & Christenson

[57] ABSTRACT

A top access cabinet (12) includes a cover (18) pivotably mounted thereto by a hinge and lever arrangement which permits the cover to pivot and slide with respect to the cabinet so that the cover can drop behind the rear wall of the cabinet when the cover is opened. Hinges (54) mount the cover (18) to the cabinet (12) along the rear wall (22) of the cabinet (12). Elongate slide members (60, 62) supported by the hinges (54) slidably mount channel members (56, 58) secured to the underside of the cover. Lever arms (32) disposed on each side of the cover (18) are mounted between the side walls (24, 26) of the cabinet and the cover. When the cover is raised, the lever arms (32) displace the cover (18) relative to the cabinet so that the channel (56, 58) members slide over the slide members (60, 62). Since the cover is slidably mounted relative to the cabinet, the lever arms (32) displace it rearwardly when lifted so that the cover is moved to a position behind the rear wall of the cabinet and thereby provide free access to the interior of the container. In order to slow descent of the cover and eliminate excessive wear on the hinges and levers, a spring-biased retarding mechanism (44) or equalizer including a stop member (86) is mounted to the cover (18).

11 Claims, 5 Drawing Figures

MOBILE FILE LID

BACKGROUND OF THE INVENTION

1. Technical Field

The invention relates to a cabinet for storing files or the like including a cover mounted by a hinge and lever arrangement which permits the cover to slide behind the rear wall of the cabinet when opened so as to provide free access to the cabinet.

2. State of the Prior Art

Top access cabinets which may be used to store files or other materials are generally provided with a cover to protect the contents therein. The covers are typically mounted to the cabinet by a hinge so that the cover may be raised to provide access to the cabinet. In such cabinets the cover often interferes with access to the cabinet and it is at times necessary to provide some means for maintaining the cover in a raised position to prevent accidental closing.

In order to provide the desired access to such cabinets, it has been found desirable to mount a cover by means of a hinge or other structure which allows the cover to slide behind the rear wall of the container when opened. One such cabinet is that disclosed in the Hunter U.S. Pat. No. 2,071,930, issued Feb. 23, 1937. The cover is mounted by means of a pivot and linkage arrangement and includes rollers which slide in channels in the side walls of the container. When the rollers clear the channel, the cover tilts behind the rear wall of the container.

Another similar cabinet is that disclosed in the Spindler et al U.S. Pat. No. 2,758,744, issued Aug. 14, 1956, wherein the cover is both slidably and pivotably mounted to the cabinet. This cover is mounted by means of a plate and channel arrangement and the cover slides rearwardly of the cabinet when lifted. The Wolters et al U.S. Pat. No. 2,338,477 issued Jan. 4, 1944, discloses a filing cabinet wherein the cover is pivotably mounted so as to drop behind the rear wall of the cabinet. The cover is mounted by a linkage including rollers received in tracks on the side walls of the cabinet. When opening the container, the cover slides rearwardly and then pivots downwardly behind the rear wall.

The Dumas et al U.S. Pat. No. 4,119,240 discloses a receptacle having a cover operated by means of a footpedal. The cover is mounted by a two arm linkage so that the cover may drop behind the rear wall of the container when opened. Other U.S. Pat. Nos. which show pivotably or slidably mounted covers are the Levin 2,323,093; King 2,545,959; Durand et al 2,682,351 and the Eckel 3,961,723.

The covers in the above referenced patents are typically mounted by means of a linkage arrangement or some type of slide mechanism including rollers and channels in the sides of the container. The references, however, do not show a simple hinge arrangement for mounting the covers wherein the hinge permits the cover to slide relative to the cabinet so that the cover drops behind the rear wall of the cabinet when opened.

DESCRIPTION OF THE INVENTION

In accordance with the invention, a top access cabinet includes a generally rectangular container for storing files or the like. The container has four walls and includes a cover pivotably mounted to the cabinet along a pivot axis at the rear of the cabinet. The cover is mounted by hinge means which allows for pivoting movement of the cover about the pivot axis between an opened and closed position. The hinge means includes a first flange which is secured to the rear wall of the cabinet and a second flange pivotably mounted to the first flange. The cover is slidably mounted to the second flange so that the cover is translatable rearwardly with respect to the front wall of the cabinet. The cabinet also includes a means for guiding the movement of the cover with respect to the rear wall of the cabinet so that as the cover moves rearwardly, it pivots about the pivot axis from a horizontal position to a substantially vertical position.

The cover is slidably mounted by means of a channel member which is secured to the underside of the cover and a slide member which is slidably received in the channel member. The slide member is secured to the second flange which forms part of the hinge. When the cover is opened, the channel members are displaced relative to the slide member which is maintained in a fixed position relative to the cover since it is attached to the hinge. In order to facilitate sliding movement of the cover, the slide and channel members are mounted by means of a ball bearing mount.

The pivoting movement of the cover is guided by means of lever arms mounted between the cover and the cabinet side walls. The lever arms are substantially straight members having a portion adjacent the connection to the cover which is angled so as to allow the cover to pivot from a position overlying the cabinet to a position at least partially behind the rear wall when opened.

In order to slow the descent of the cover and thereby avoid excessive wear on the hinge and lever arms as well as eliminate annoying noise, the cover includes an equalizer or retarding mechanism which slows the movement of the cover. The equalizer or retarding mechanism is a spring-biased member carried on the cover which engages the cabinet rear wall as the cover drops behind the cabinet. The spring-biased member includes a stop member having a depending portion which engages the cabinet rear wall as the cover slides downwardly. This stop member is slidable in a channel mounted to the underside of the cover.

The mounting of the cover to a cabinet by means of the lever arms and the slide and channel members allows the cover to be opened to a position so that it is at least partially behind the rear wall of the cabinet. In this way, unimpaired access to the interior of the cabinet is provided and the cover is placed completely out of the way of a person needing access to the cabinet.

BRIEF DESCRIPTION OF THE DRAWINGS

The invention will be described with reference to the accompanying drawings wherein like members bear like reference numerals in which.

DETAILED DESCRIPTION OF THE PREFERRED EMBODIMENT

Figure 1:
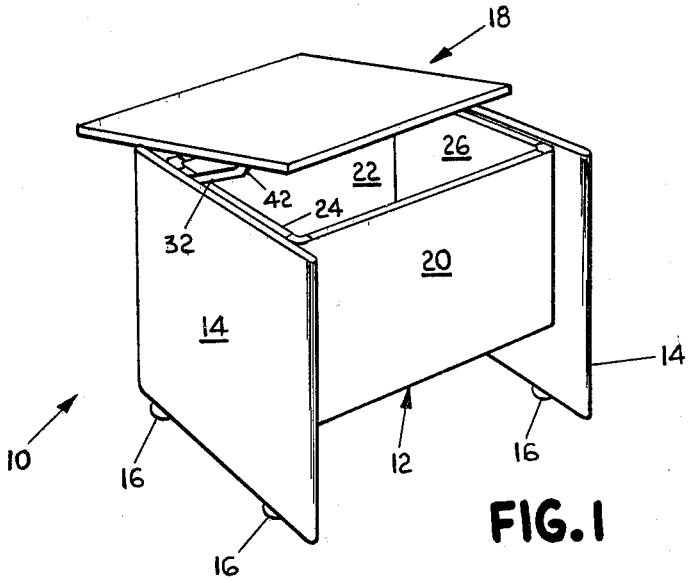
FIG. 1 is a perspective view of a mobile cart including a container with a cover in accordance with the invention.
Figure 2:
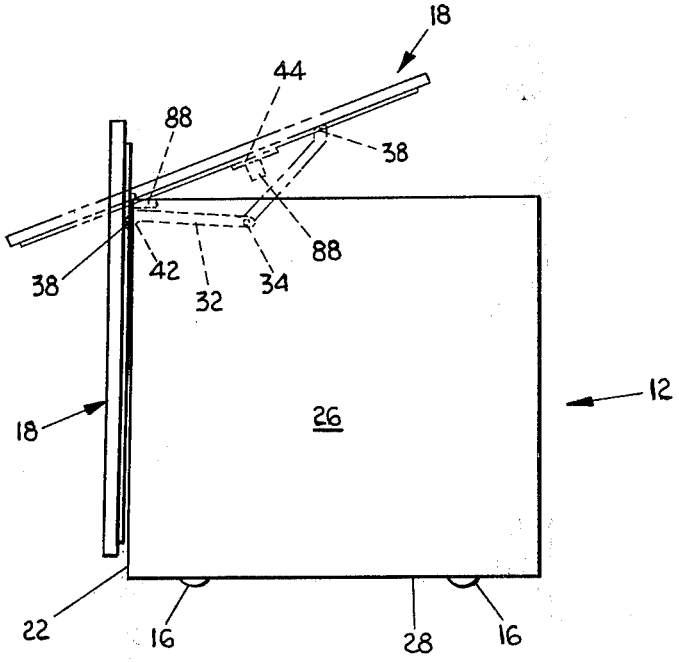
FIG. 2 is a side view of the cart of FIG. 1 with one wall removed showing the cover in a partially opened and a fully opened position.

With reference to FIGS. 1 and 2, a mobile cart 10 includes a cabinet 12 mounted on support walls 14. The cabinet 12 is secured to the support walls 14 by means of screws or the like. The support walls 14 may be provided with rollers 16 to allow the cart to be transported about in an easy manner. Alternatively, the cabinet may be stationary or supported on a pedestal or the like. The cabinet 12 includes a cover 18 which is pivotably mounted to the cabinet.

The cabinet 12 has a generally rectangular configuration and includes a front wall 20, a rear wall 22, side walls 24 and 26 and a bottom wall 28. The size of the cabinet may be varied and various dividers, rails for mounting files or the like may be provided within the cabinet. The cabinet itself may be made of molded plastic or metal. Along the upper edge of each wall is a lip 30 on which the cover 18 rests when the cabinet is closed. It should be noted that the support walls 14 extend above the height of the side walls 24 and 26 by distance equal to the width of the cover 18. In this way, when the cabinet is closed, the cover 18 is substantially flush with the support walls 14 so as to present a pleasing aesthetic appearance.

The cover 18 is mounted to the cabinet 12 by means of a hinge structure which will be described below and lever arms 32. The lever arms 32 are pivotably mounted to the cabinet by pins 34. The lever arms 32 are mounted to the inside of the side walls 24 and 26 of the cabinet. The arms 32 are also pivotably mounted to the cover 18 by means of pins 38. As can be seen in FIG. 2, which shows the cover 18 in a partially opened and a fully opened position, the lever arms 32 are generally straight members with a slightly angled portion 42 at the end thereof where attached to the cover. This slightly angled portion 42 permits the cover to rest behind the back wall 22 of the cabinet when in a fully opened position.

The cover 18 also mounts a retarding mechanism 44 for slowing the descent of the cover when opened. The structure of this retarding mechanism 44 will be described below.

Figure 3:
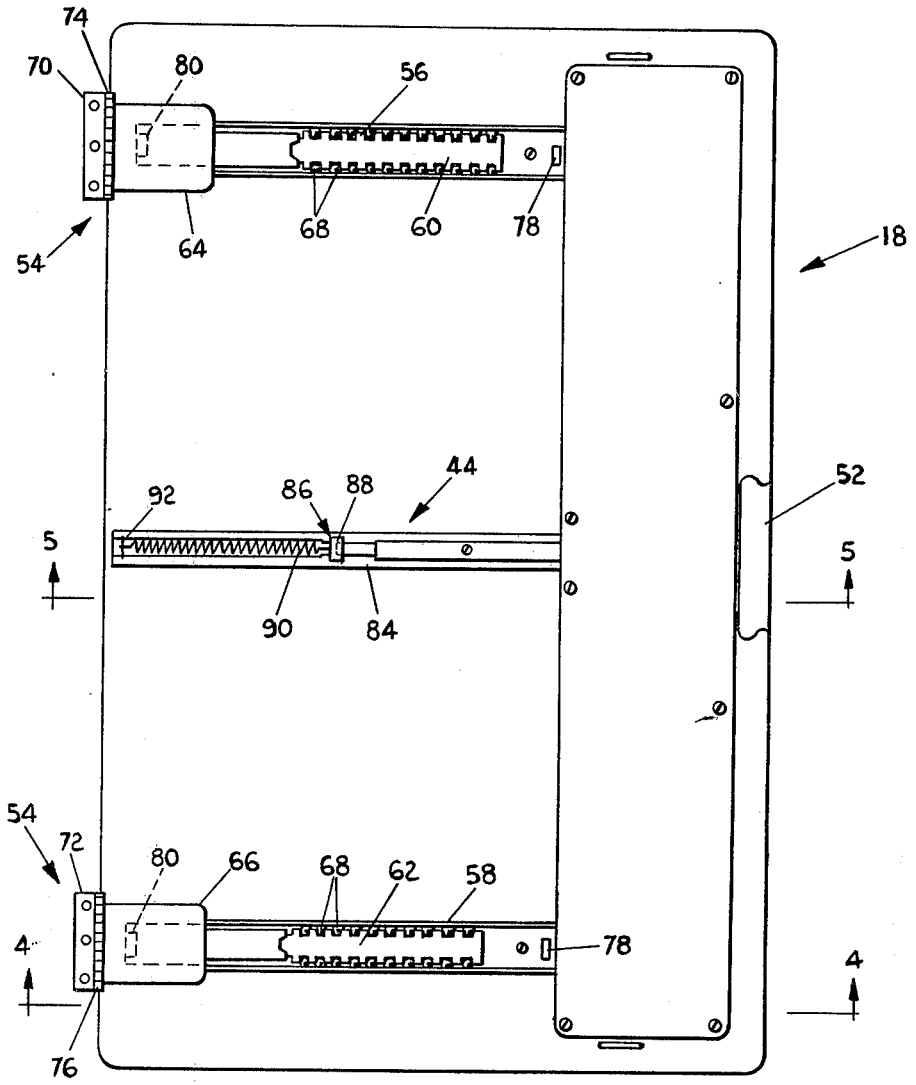
FIG. 3 is a plan view of the underside of the cover in accordance with the invention.
Figure 4:
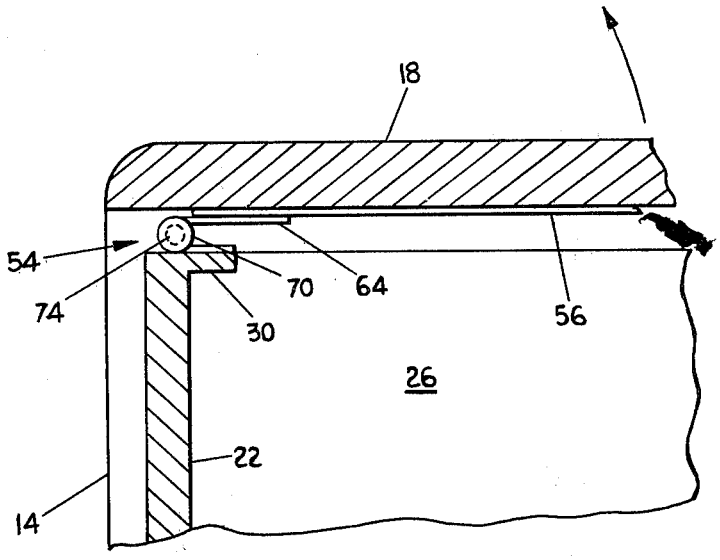
FIG. 4 is a detailed cross-sectional view taken along lines 4—4 of FIG. 3 showing the mounting of the cover.

With reference to FIGS. 3 and 4, the details of the cover and mounting of the cover to the cabinet 12 are shown. The cover 18 includes a recess 52 which provides a grip for opening the cover. The cover 18 is mounted to the cabinet 12 by a hinge 54 which is secured between the cover 18 and the rear portion of the cabinet. The hinge 54 includes first flange members 70 and 72 which are secured to the lip 30 of the rear wall 22 of the cabinet 12. The first flange member 70 and 72 may be secured to the cabinet by means of the screws or the like. Pivotably secured to the first flange member 70 and 72 along pivot pins 74 and 76 are second flange members 64 and 66, so as to form a conventional-type hinge.

As shown in FIG. 3, channel members 56 and 58 are secured to the underside of the cover 18. The channel members 56 and 58 have a generally U-shaped configuration and are mounted to the cover by means of screws or the like. Slidably received in the channel members 56 and 58 are slide members 60 and 62 which are generally flat elongate metal strips. In order to facilitate sliding movement between the channel and slide members ball bearings 68 are disposed between the channel and slide members. The slide members 60 and 62 are secured to the second flanges 64 and 66 which form part of hinge 54. In this way, when the cover is moved to an open position, the channel members 56 and 58 slide over the slide members 60 and 62 which are stationary relative to the cover since they are supported by the hinge 54.

At each end of the channel members 56 and 58 are stop members 78 and 80 which limit sliding movement of the channel members over the slide members. The stop members 78 and 80 may be provided with a resilient cover to eliminate noise generated when the cover is opened or closed.

Figure 5:
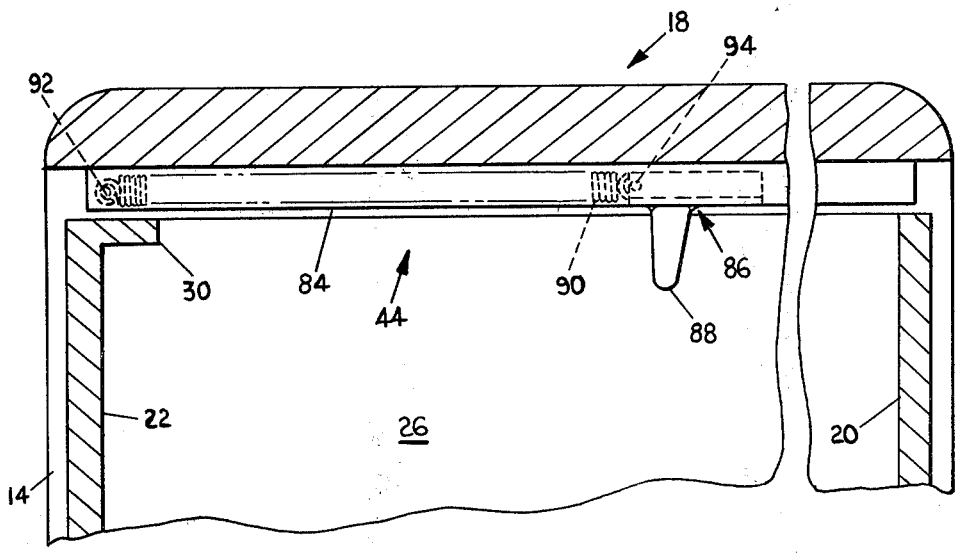
FIG. 5 is a cross-sectional view along lines 5—5 of FIG. 3 showing the cover retarding mechanism in accordance with the invention.

With reference to FIGS. 3 and 5, the retarding mechanism 44 for slowing descent of the cover 18 when opened is shown. The retarding mechanism 44 includes a channel 84 in which a stop member 86 is slidably mounted. The channel 84 has a generally U-shaped configuration, with the legs of the U including a turned-over flange for retaining the stop member 86 in the channel. The stop member 86 is preferably a plastic member and includes a depending flange 88 which abuts the back wall of the container when the cover is open to slow descent thereof. The stop member 86 is mounted to a coil spring 90 disposed in the channel 84. The coil spring 90 is mounted to a pin 92 at the rear portion of the channel 84. The coil spring 90 is secured to the stop member 86 by means of a second pin 94. The retarding mechanism 44 is secured to the underside of the cover 18 by means of screws and is positioned so that the stop member 86 abuts the rear wall 22 of the cabinet before the cover is fully opened so as to slow the descent of the cover. The coil spring 90 also aids in closing of the cover by providing a slight forward bias as the spring relaxes.

The cover, in a closed position, is substantially flush with the top surfaces of the support walls 14. In order to open the cover, the cover is gripped by the recess 52 and lifted upwardly. In lifting the cover upwardly, the lever arms 32 guide the cover through a predetermined angle of rotation. As the cover is lifted, the channel members 56 and 58 secured to the underside of the cover slide, by means of the ball bearings 68, over the slide members 60 and 62 which are stationary relative to the cover. Both the slide members and channel members are displaced in an angular sense relative to the cabinet since the slide and channel members are pivotable relative to the cabinet by the hinge structure comprising the flanges and pivot axes 74 and 76.

The rotational movement of the cover 18 is shown in FIG. 2. As can be seen, the cover slides rearwardly as it is lifted upwardly. Accordingly, it is necessary to provide some clearance from a wall or other object in order to allow the cover to be moved to the open position. As the cover slides rearwardly, the retarding mechanism 44 and stop member 86 thereof is brought into contact with the rear wall 22 of the cabinet. As shown in FIG. 2, the depending flange 88 catches the rear wall of the cabinet as the cover slides downwardly. In this way, the opening of the cover is slowed so as to prevent annoying noise or damage to the hinge structure if the cover is dropped into the open position.

In the fully opened position, as shown in FIG. 2, the cover is substantially behind the rear wall 22 of the cabinet. This allows for free access to the interior of the cabinet for removing files or other materials stored therein and places the cover out of the way of the person requiring access to the cabinet. The angled portion 42 on the lever arms 32 permits the cover to be moved to a position substantially behind the rear wall 22 so that it is generally parallel to the rear wall. The lever arms control the angular rotation of the cover and provide for a selected displacement. The length of the arms is therefore selected so as to permit the cover to drop behind the rear wall of the container when opened and thereby provide maximum clearance for access to the interior of the cabinet.

The foregoing description and drawings are merely illustrative of the invention and are not intended to limit the invention to the above-described embodiment. Variations and changes which may be obvious to one skilled in the art may be made without departing from the scope and spirit of the invention as defined in the appended claims.

The embodiments of the invention in which an exclusive property or privilege is claimed are defined as follows:

1. A top-access cabinet comprising:

a front wall, a rear wall and two side walls;

a cover pivotably mounted to said cabinet along a pivot axis at the rear of the cabinet;

hinge means for mounting the cover for pivotal movement about the pivot axis between an open and closed position;

said hinge means including a first flange secured to said cabinet rear wall;

a second flange pivotably mounted to said first flange;

means for slidably mounting said cover to said second flange so that said cover is translatable rearwardly with respect to said front wall; and means for guiding movement of said cover with respect to said rear wall so that said cover means moves rearwardly only as it pivots about said pivot axis from a horizontal position overlying the cabinet to a substantially vertical position;

whereupon as said cover is pivoted from a horizontal to the substantially vertical position said cover moves from a position overlying the cabinet to a position at least partially behind the cabinet rear wall.

2. The cabinet of claim 1 wherein said means for slidably mounting said cover includes:

at least one channel member secured to the underside of said cover;

at least one slide member slidably received in said at least one channel member and secured to said second flange so that said slide member is fixed relative to said cover;

whereupon opening of said cover said at least one channel member is displaced relative to said at least one slide member.

3. The cabinet of claim 2 including two channel members and two slide members.

4. The cabinet of claim 3 including ball bearings mounted between said channel member and said slide member to facilitate sliding movement therebetween.

5. The cabinet of claim 1 wherein said means for guiding movement of said cover with respect to said rear wall includes lever arms pivotably mounted between said cover and said cabinet side walls.

6. The cabinet of claim 5 wherein said lever arms are substantially straight members having a portion adjacent the point at which the lever is mounted to the cover which is sufficiently angled so as to allow the cover to pivot from a position overlying the cabinet to a position at least partially behind the cabinet rear wall.

7. The cabinet of claim 5 wherein said lever arms guide said cover through a selected angular displacement when the cover is pivoted to the open position.

8. The cabinet of claim 1 further comprising means for slowing the descent of the cover when pivoted from a position overlying the cabinet to a position at least partially behind the cabinet rear wall.

9. The cabinet of claim 8 wherein said means for slowing descent of said cover includes a spring-biased member carried on said cover which engages the cabinet rear wall when said cover is pivoted.

10. The cabinet of claim 9 wherein said spring-biased member includes a stop member having a depending portion which engages said cabinet rear wall.

11. The cabinet of claim 10 wherein said stop member is slidably mounted in a track secured to the underside of said cover.

* * * * *